United States Patent [19]

Maina

[11] Patent Number: 4,719,947

[45] Date of Patent: Jan. 19, 1988

[54] ROTOR FOR WEFT FEEDING DEVICE FOR WEAVING LOOMS

[75] Inventor: Bruno Maina, Valdengo, Italy

[73] Assignee: Roj Electrotex S.p.A., Biella, Italy

[21] Appl. No.: 658,804

[22] Filed: Oct. 9, 1984

[30] Foreign Application Priority Data

Oct. 7, 1983 [IT] Italy ..... 23186/83[U]

[51] Int. Cl.[4] ..... D03D 47/36; B65H 51/20

[52] U.S. Cl. ..... 139/452; 242/47.01

[58] Field of Search ..... 139/452; 242/47.01, 242/47.12, 47.13; 301/37 R

[56] References Cited

U.S. PATENT DOCUMENTS

| | | | |
|---|---|---|---|
| 2,123,025 | 7/1938 | Ramirez | 301/37 R |
| 2,136,137 | 11/1938 | Kellogg | 301/37 R |
| 2,837,376 | 6/1958 | Bruno | 301/37 R |
| 3,411,548 | 11/1968 | Pfarrwaller | 242/47.01 |
| 3,759,300 | 9/1973 | Pfarrwaller | 139/452 |
| 3,761,031 | 9/1973 | Pfarrwaller | 139/452 |
| 4,165,049 | 8/1979 | Pejchal et al. | 139/452 |
| 4,407,336 | 10/1983 | Steiner | 139/452 |
| 4,591,107 | 5/1986 | Tholander | 242/47.01 |

*Primary Examiner*—Harvey C. Hornsby
*Assistant Examiner*—Joseph S. Machuga
*Attorney, Agent, or Firm*—Young & Thompson

[57] ABSTRACT

A rotor for weaving loom weft feeding devices, comprises a framework formed by a hub, a plurality of spokes extending outwardly from the hub at an oblique angle, and an outer circular rim. One of the spokes is larger than the others and contains the weft yarn passageway extending lengthwise thereof. Two thin covers enclose the framework and are fixed securely to it, which eliminates the build up of dust between the spokes. The rim defines annular recesses within which the motor casing on one side and the winding drum on the other side nest.

3 Claims, 3 Drawing Figures

ROTOR FOR WEFT FEEDING DEVICE FOR WEAVING LOOMS

BACKGROUND OF THE INVENTION

This invention relates to improvements in weaving loom weft feeding device, i.e. those devices which withdraw from a reel the weft yarn for feeding to the loom and form therewith a small store of turns on a winding drum, from which the loom withdraws it under a substantially constant minimum tension.

These devices have become essential for the correct operation of modern high-speed looms, and are the subject of continuous improvements in all their parts.

Of these parts, one which is of considerable importance is the rotor which is keyed onto the weft feeding device drive shaft, and by means of which the yarn withdrawn from the reel is deposited on the drum on which the stored turns are wound. The present invention relates to an improved rotor for fitting to a weft feeding device of the type in which the yarn passes through the hollow shaft of the device motor, and in which the winding drum is rotatably mounted but kept stationary with respect to said shaft.

SUMMARY OF THE INVENTION

The rotor according to the invention is characterised by being formed by a framework comprising a hub, a plurality of spokes and an outer rim, and two thin covers which enclose said framework and are fixed securely to it.

In this rotor, the profile of the outer rim is of such a form that on one side it reproduces the shape of the motor casing and on the other side it reproduces the shape of the winding drum of the weft feeding device to which the rotor is fitted.

BRIEF DESCRIPTION OF THE DRAWINGS

The invention is described in greater detail hereinafter by way of example with reference to a preferred embodiment illustrated on the accompanying drawings, in which:

FIG. 1 is a front view of the rotor, of which:

DESCRIPTION OF THE PREFERRED EMBODIMENTS

Figure 1:
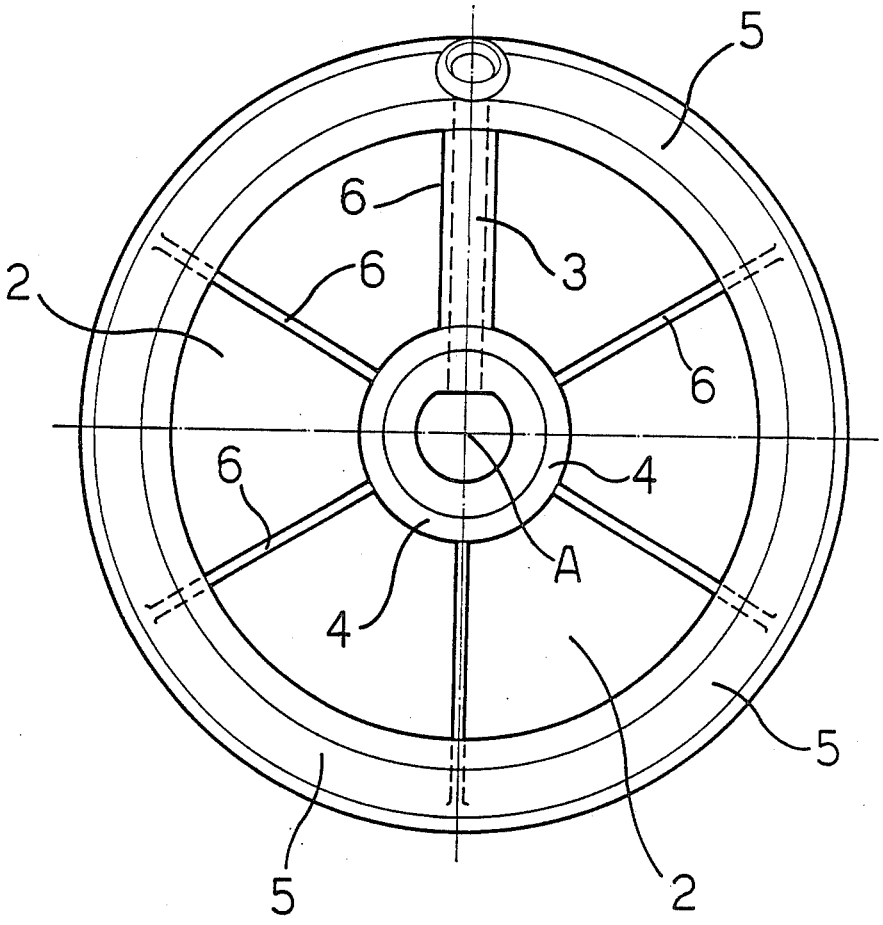
Figure 2:
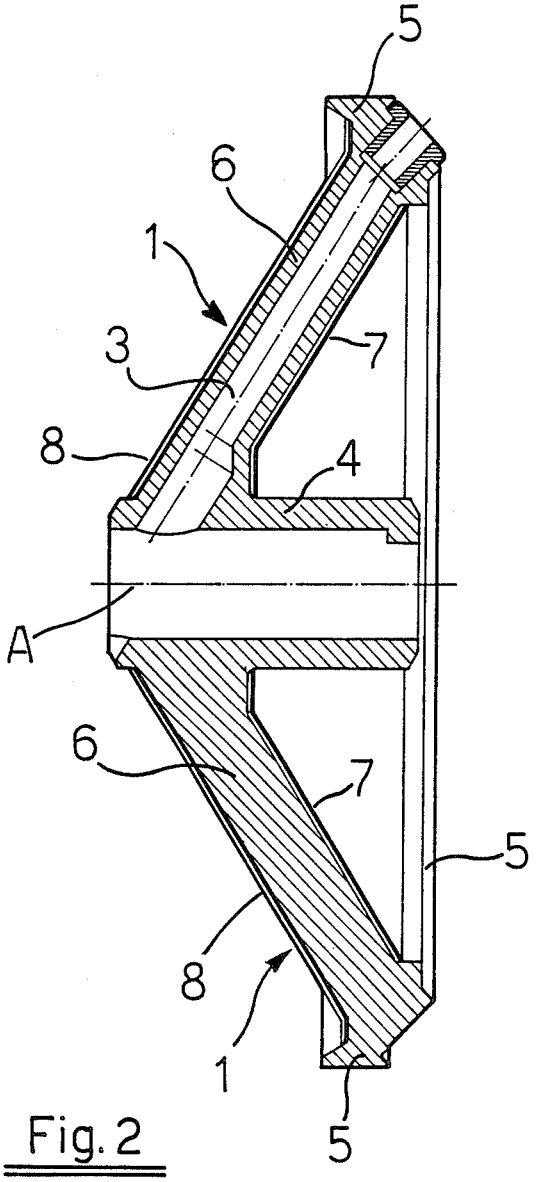
FIG. 2 is an axial section therethrough.

The rotor according to the invention is constituted by a disc 1 of frusto-conical section, lightened internally by large apertures 2 in order to reduce the moment of inertia, and enclosing in its interior the yarn passage duct 3. The inclination of the disc is about 60° to the rotor axis A (and to the axis of the shaft on which it is keyed in order to be rotated by the weft feeding device motor) in order to facilitate the yarn flow through the duct 3.

More specifically, the rotor is constituted by a framework formed by a hub 4, an outer rim 5 and spokes 6 which connect the hub 4 to the rim 5, and of which one, which is larger than the others, contains the yarn passage duct 3.

Although this type of construction, which can be called open construction, enables the rotor to properly operate as an element for depositing the yarn on the winding unit, it would have the drawback when rotating at high speed of trapping between its spokes the dust which is known to be generated in all textile processing, especially where there is yarn flow, and it is preferred to give the rotor a "closed" form by fitting two very thin covers 7 and 8, one on each side, of such a shape as to rest against the edges of the hub 4, against the backs of the spokes 6 and against the edges of the outer rim 5.

Said covers are fixed in a secure and permanent manner to the rotor framework.

This embodiment of the rotor according to the invention on the one hand enables the moment of inertia of the rotating unit of the weft feeding device to be kept very small, and on the other hand gives the weft feeding device the appearance of a smooth-walled disc, so preventing dust depositing on its outwardly extending parts.

A typical drawback of systems in which the yarn is wound by a rotor in weft feeding devices is the possibility that the yarn, generally as a result of its breakage or incorrect use of the weft feeding device, tends to wind around the rotor hub and become entangled.

To obviate this drawback, the outer rim of the rotor according to the invention has a shape on one side which "reproduces" the profile of the outer casing of the weft feeding device, or rather of the motor casing, and has a shape on the other side which "reproduces" the edge of the weft feeding device winding drum.

Figure 3:
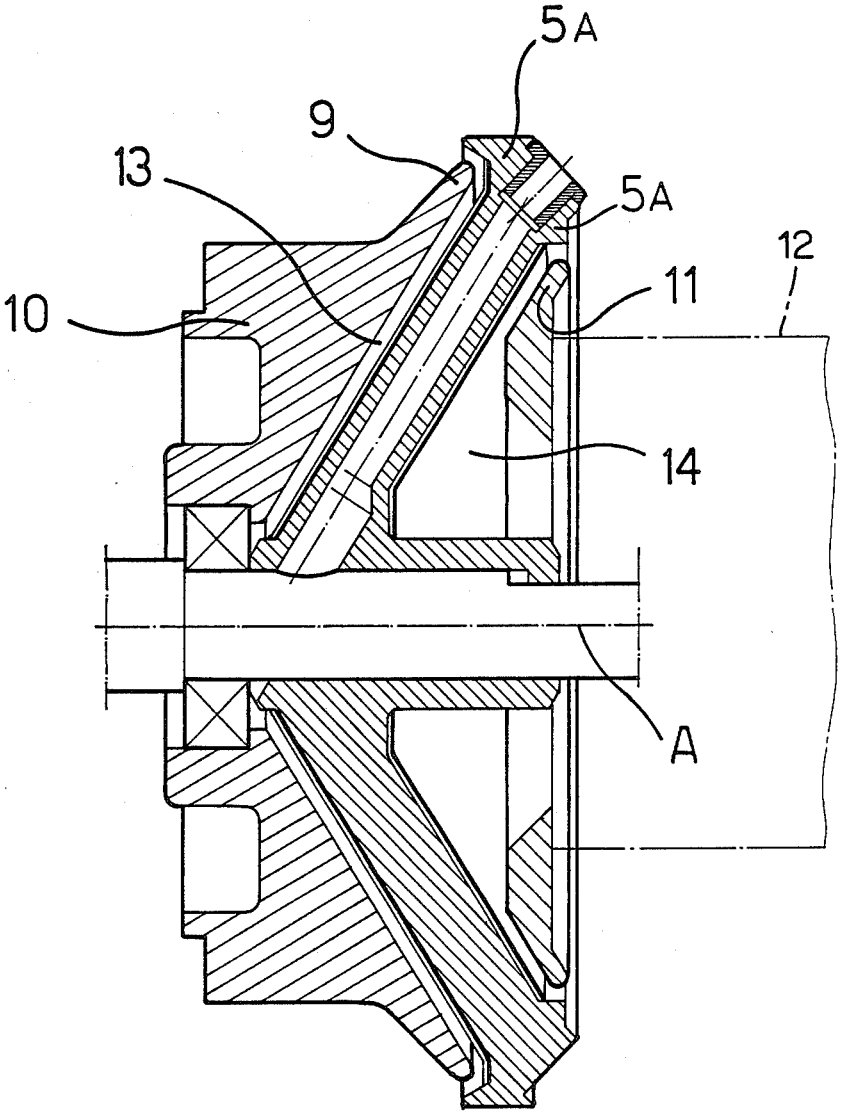
FIG. 3 shows the rotor of FIGS. 1 and 2 mounted in the weft feeding device, together with the immediately adjacent parts of this latter.

This arrangement is shown in FIG. 3 of the drawing, in which it can be seen that the edge 5A of the rotor rim 5 reproduces both the profile 9 of the motor casing 10 and the profile 11 of the weft feeding device winding drum 12.

The characteristic of the rotor edge is that it becomes superposed on said profiles of the fixed parts while remaining separated from them by narrow gaps, thus preventing the yarn reaching the rotor hub 4 and winding about it.

The constructional arrangement used simultaneously creates two chambers 13 and 14 into which it is not possible for dust to penetrate and accumulate in that the wall of the motor casing 10, which together with the rotor forms the chamber 13, does not possess any communication passages with the outside on its surfaces, and the wall of the winding unit which together with the rotor forms the chamber 14 also possesses no passages of communication with the outside. Thus the only zones of communication with the outside possessed by the chambers 13 and 14, which do not communicate with each other because the rotor is the "closed" type, are the peripheral end edges forming the narrow gaps with the edges of the outer rim 5 of the rotor.

The air flow generated by the rotation of these latter forms a further obstruction to the entry and deposition of dust in the zones 13 and 14 adjacent to the rotor.

This embodiment therefore provides effective protection against tangling and dust for the rotor unit and for the zone close to it.

I claim:

1. A rotor for a weaving loom weft feeding device, comprising a framework comprising a hub, a plurality of spaced-apart spokes extending outwardly from the hub and interconnected at their outer ends by a circular rim, and two thin covers which enclose the spaces between the spokes and are fixed securely to the framework one on each side of the plurality of spokes, said rim defining annular recesses on opposite sides thereof, one of said recesses being adapted to receive in nested relation a portion of a casing of a motor for driving the rotor and the other of said recesses being adapted to receive in nested relation a portion of a winding drum of a weft feeding device to which the rotor is secured.

2. A rotor as claimed in claim 1, one of said spokes being hollow and constituting a weft yarn passageway.

3. A rotor as claimed in claim 2, said one spoke being larger than the other spokes.

* * * * *